United States Patent [19]

Harper

[11] Patent Number: 4,692,124

[45] Date of Patent: Sep. 8, 1987

[54] SAIL RAFT - CONVERTIBLE INFLATABLE LIFE RAFT

[76] Inventor: Terry Harper, Box 731, Venice, Calif. 90294

[21] Appl. No.: 788,418

[22] Filed: Oct. 17, 1985

[51] Int. Cl.[4] ..... B63C 9/02; B63C 9/04

[52] U.S. Cl. ..... 441/40; 114/102; 114/125; 114/39

[58] Field of Search ..... 114/39.1, 102, 125, 114/126, 345; 52/148, 149, 150; 441/40, 41, 42

[56] References Cited

U.S. PATENT DOCUMENTS

| | | | |
|---|---|---|---|
| 2,351,275 | 6/1944 | McConnel | 52/148 |
| 2,444,717 | 7/1948 | Allen | 441/41 |
| 3,338,266 | 8/1967 | Zilka et al. | 441/41 |
| 3,601,076 | 8/1971 | Meeks | 441/41 |
| 4,001,905 | 1/1977 | Givens | 114/125 |
| 4,082,049 | 4/1978 | Nicol | 114/354 |
| 4,149,481 | 4/1979 | Leber | 114/39 |
| 4,249,276 | 2/1981 | Snyderman | 114/102 |
| 4,466,763 | 8/1984 | Fischer | 114/352 |

FOREIGN PATENT DOCUMENTS

| | | | |
|---|---|---|---|
| 2537043 | 3/1977 | Fed. Rep. of Germany | 114/39 |
| 206766 | 2/1984 | German Democratic Rep. | 441/35 |
| 568444 | 4/1945 | United Kingdom | 114/345 |

OTHER PUBLICATIONS

Metzeler Inflatables brochure of 1985.

*Primary Examiner*—Jeffrey V. Nase
*Assistant Examiner*—Thomas J. Brahan

[57] ABSTRACT

The self-inflating convertible life raft may be launched from a distressed ship or a downed aircraft. Suspended from the sides of the hull are uniquely positioned anti-capsize water ballast bags which are fully retractable to allow for life raft maneuverability. In order to convert the life raft into an effective sailing boat; the mast, sails, lee board, and tiller-rudder assembly are stowed inside a standard-sized lift raft cannister or valise. This easily assembled gear allows the user to effect self-rescue by sailing the life raft to a chosen destination.

1 Claim, 20 Drawing Figures

FIG. 2a
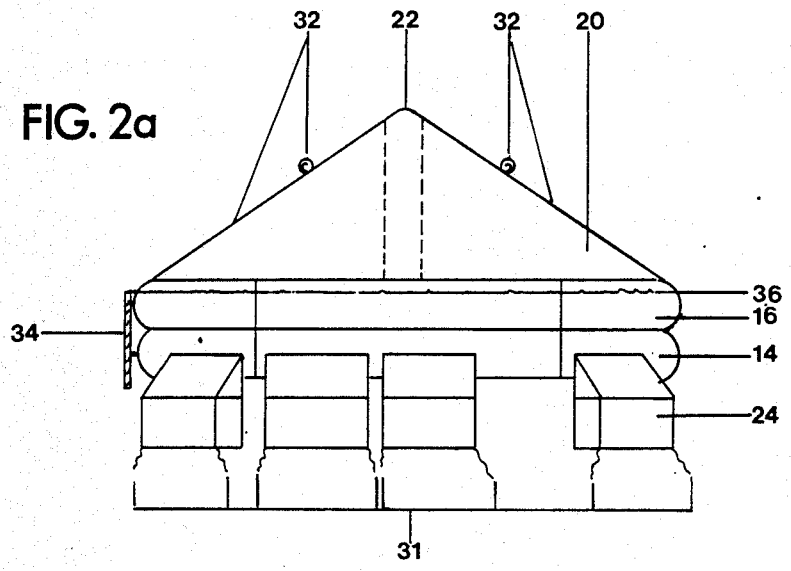
FIG. 2b
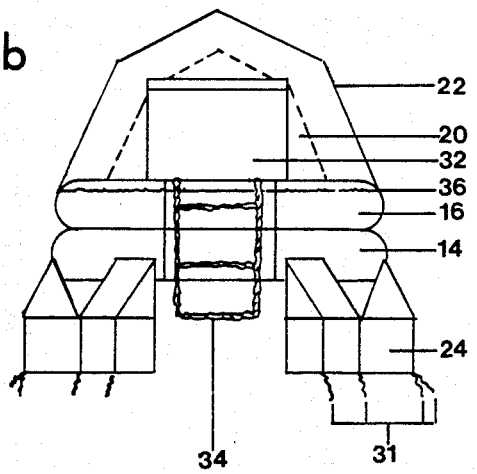
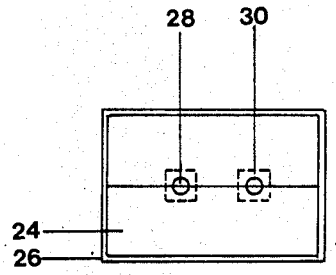
FIG. 3b
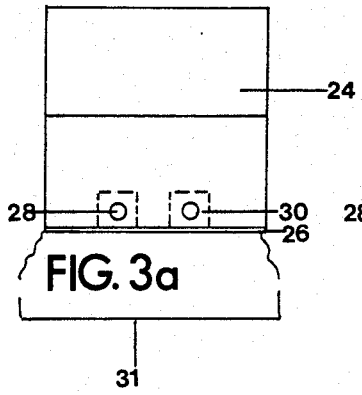
FIG. 3a
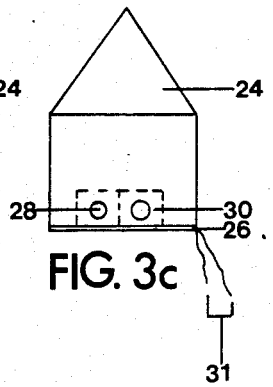
FIG. 3c FIG. 5b
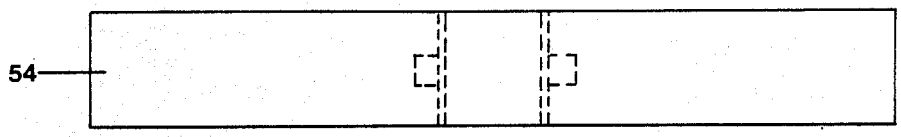
FIG. 5a
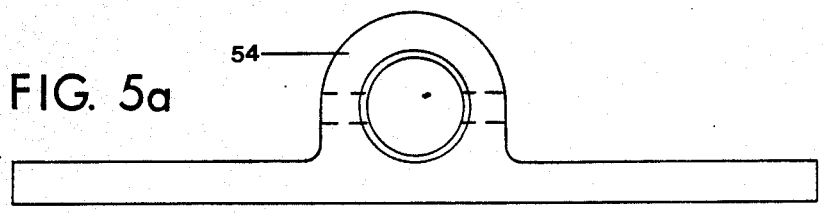
FIG. 5c
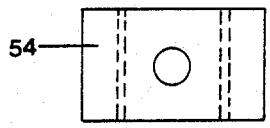
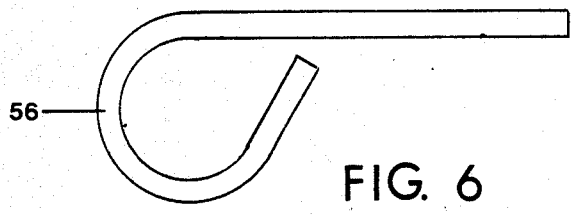
FIG. 6

FIG. 7a
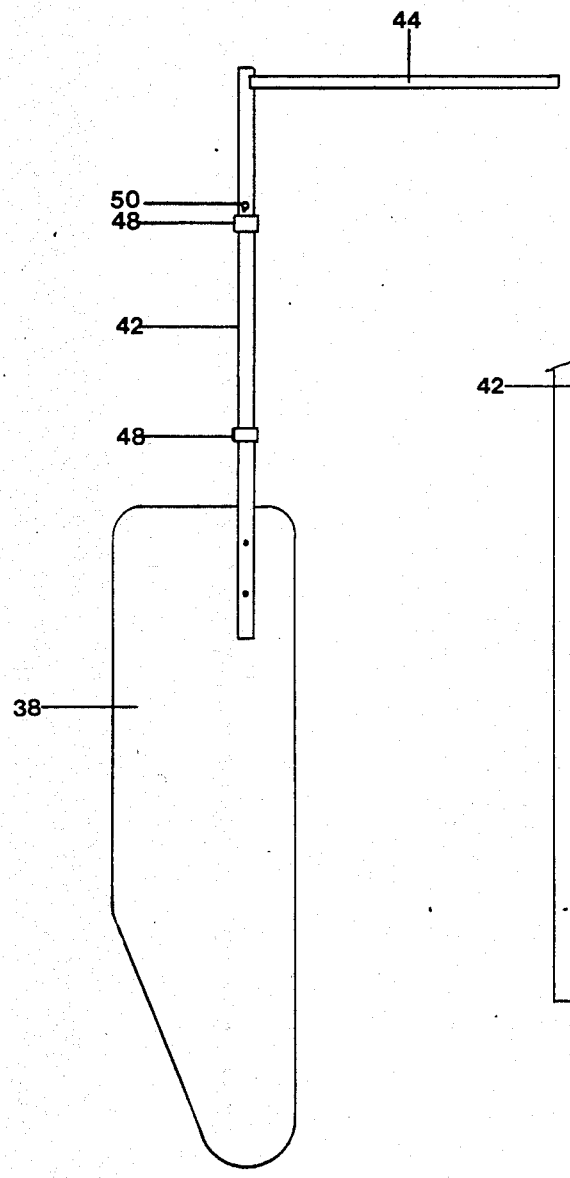
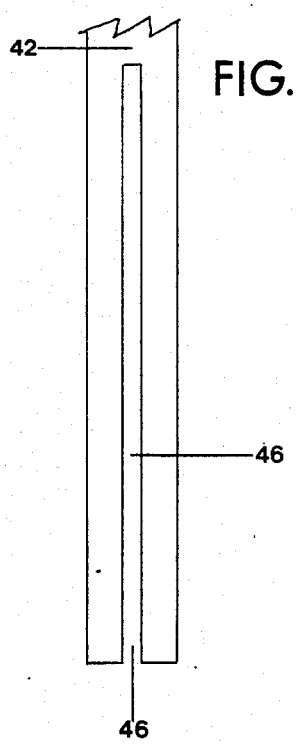
FIG. 7b

FIG. 8a
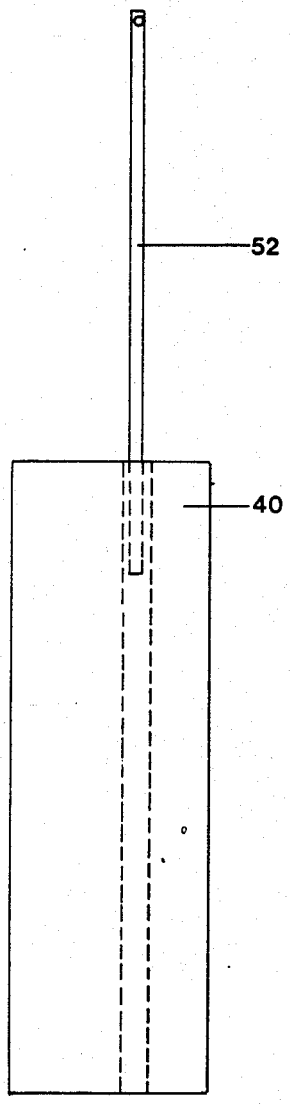
FIG. 8b
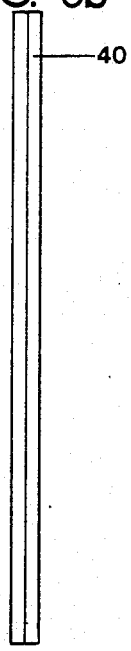
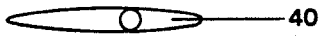
FIG. 8c

SAIL RAFT - CONVERTIBLE INFLATABLE LIFE RAFT

BACKGROUND OF THE INVENTION

The design and fabrication of life rafts are well-known to the art. The purpose of existing life rafts is for people abandoning an imperiled ship and then waiting in the life raft for an undetermined time for the possibility of rescue from outside sources.

Existing life rafts can be divided into two groups. The first group has anti-capsize water ballast bags which are mounted on the underside of the life raft. Their purpose is to collect and contain sea water for ballast in order to reduce chance of capsize from a storm, turbulent seas, or aggressive sea life. Some life rafts have ballast bags which can be intentionally collapsed; but those life rafts can not be sailed effectively because the collapsed ballast bag material would foul the hydrodynamics of a boat under way.

The second group of life rafts has no anti-capsize water ballast bags. Neither group has sailing capabilities outside of drifting dead down wind.

In emergency situations, it most often becomes vitally necessary for the life raft to maneuver toward or away from the following: a sinking ship or airplane, burning fuel on the water, on-rushing traffic, jagged rocks or coral reefs, enemy capture; or injured persons, other rafts, rescue ships, or the safety of a gentle shore. Existing life rafts do not offer this maneuverability.

Existing life rafts boast of people surviving 117 days in them; whereas any sailing boat can be sailed to some landfall in much less than 117 days.

Existing life rafts have neither compass nor nautical charts on board because there is no effective method of mobility.

Users of existing life rafts literally cast their fate to the wind and suffer extreme hardships from exposure, dehydration, starvation, lack of medical facilities, and the despair of being totally out of control of the situation.

As for existing inflatable sailing boats; they endeavor to make a non-rigid hull into a rigid hull by adding bulky and heavy hardware and appliances that cannot be stowed inside a standard-sized life raft cannister or valise.

Existing inflatable sailing boats do not have anti-capsize water ballast bags.

Therefore, a life raft with fully retractable ballast bags and effective sailing gear may well be the only means to survival. The Sail Raft will promote self-rescue. The ease of assembly, use, and disassembly will reduce search and rescue time and money. The Sail Raft will save lives.

SUMMARY OF THE INVENTION

To solve the problems discussed in the Background of the Invention; the following improvements have been made.

The maneuverability begins with fully retractable anti-capsize water ballast bags. This is made possible by the unique positioning of the bags joined on the sides of the lower hull. The ballast is on the periphery as an added benefit since the periphery is where the ballast is most effective. This location also allows the bags to hang in the water when in use, and later to be lifted entirely out of the water, drained, and secured to the upper hull life line when not in use or when under way. The down and up positions of the bags are very similar to saddle bags on a horse. No existing life raft with water bags can truly or adequately retract their bags and eliminate their severely fouling the hydrodynamics of a boat under way.

A pair of substantial jury paddles may be utilized from the unassembled rudder and lee board. This would allow the Sail Raft to be used as a dinghy in the event the distressed ship was obstructing the Sail Raft's wind, or for short distances when becalmed. In a different emergency setting in which a shore boat is needed and not available; the Sail Raft may be used to get to and from shore.

The inflatable arch tube which supports the canopy is erected with the initial inflation. After that time, the arch tube may be independently deflated and inflated again without any effect on the Sail Raft hull. The purpose of deflating the arch tube is for unobstructed sail management.

Custom gudgeons are used for the tiller-rudder assembly on the stern and also for lee board mounts and weather jack mounts on the sides of the hulls.

The lee board is mounted on the lee, or downwind side of the boat. Its purpose is to provide lateral resistance, i.e., to keep the boat from drifting sideways when making way to weather.

A weather jack and partner are utilized in conjunction with the lee board to prevent the lee board from yawing and rolling when sailing to windward.

The mast is stepped into a mast socket seated on the mast plate affixed to the double floor so that the mast's compression will not puncture the floor.

The Sail Raft is sloop rigged for ease of assembly and versatility of sail combinations found with a main sail and a jib.

The mast rigging is fully adjustable to accommodate flexability of the hull. In place of a turnbuckle, a harness snap at the end of the stay can be hooked to different links of chain secured to the upper hull.

The floor is manually inflatable with length-wise air pocket seams to afford better hydrodynamics. This will also reduce a lumpy hull configuration from the users' weight bulging in the bottom.

None of these improvements makes the stowage cannister over-sized or over-weight. For example, the mast is hollow, sectional, and telescopic. The rudder is only $\frac{1}{8}''$ thick. The lee board is hollow for storage of sails, compass, nautical charts, and sailing gear.

Lastly, the effective sailing boat may easily be reconverted back into a conventional life raft at any time.

The Sail Raft is relatively simple and inexpensive to construct. The Sail Raft has direct and immediate applications in the yachting, commercial fishing, merchant marine, and military communities.

BRIEF DESCRIPTION OF THE DRAWINGS

FIG. 2*a* and FIG. 2*b* is a side and rear view of a conventional life raft with canopy arch tube inflated and water ballast bags in place.

FIG. 3*a*, FIG. 3*b*, and FIG. 3*c* is a front, top and side view of the water ballast bags with flaps for one way water flow.

FIG. 5*a*, FIG. 5*b*, and FIG. 5*c* is a front, top, and side view of the gudgeon or lee board mount with its bushing.

FIG. 6 is a side view of a quick release pin for holding the lee board and the weather jack in their mounts.

FIG. 7*a* is a side view of the assembled tiller, rudder post, and rudder. FIG. 7*b* is a partial front view of the bottom of the post, showing how the rudder is fitted at the post.

FIG. 8*a* is a side view of the lee board and its post. FIG. 8*b* and FIG. 8*c is a front and top view of the lee board.*

DESCRIPTION OF THE PREFERRED EMBODIMENTS

Figure 1:
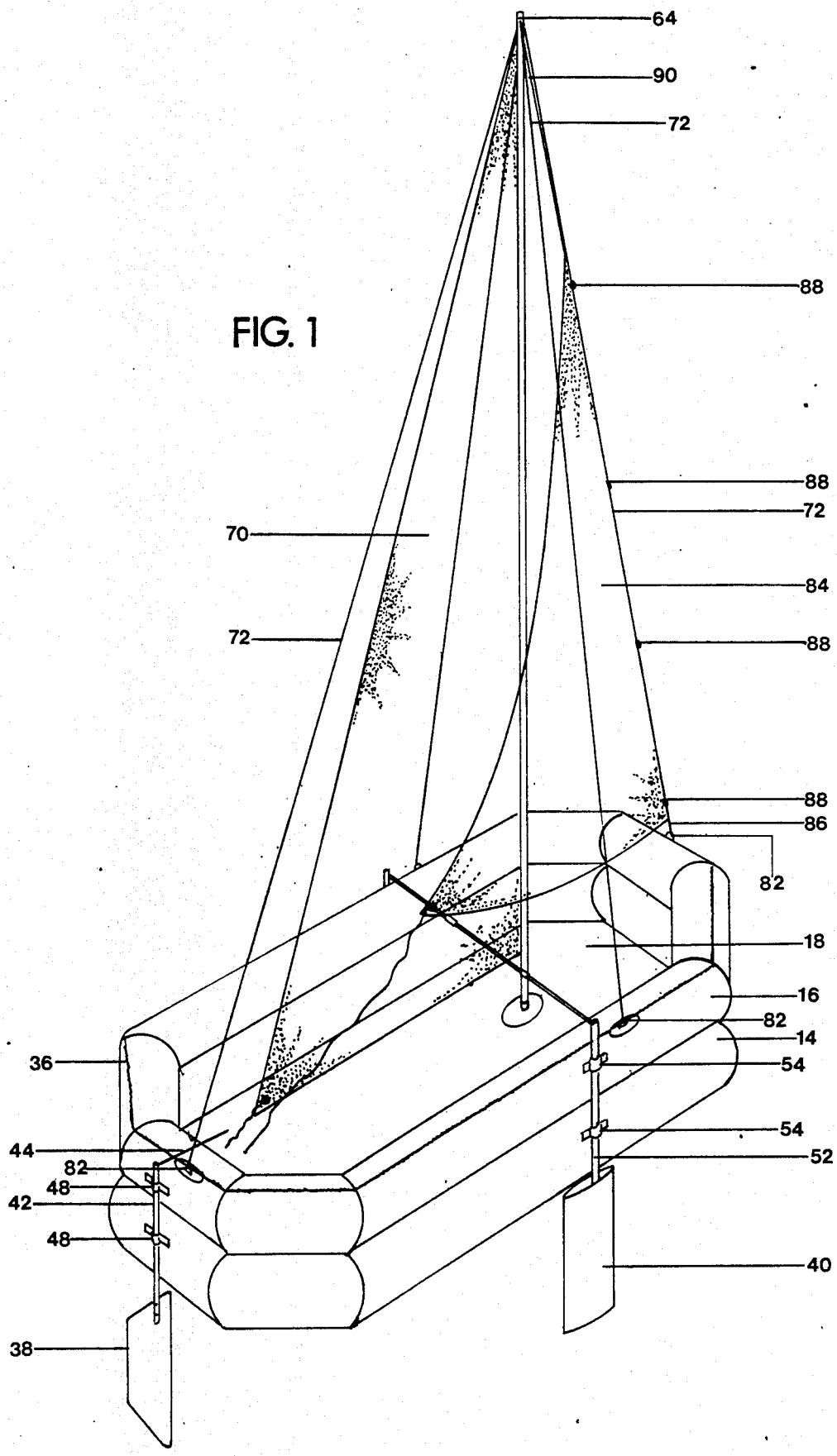
FIG. 1 is a perspective view of an effective sailing boat converted from a conventional life raft. The deflated arch tube and retracted ballast bags are not shown.

The inflatable life raft FIG. 2 consists of a lower buoyancy 14 joined to an upper buoyancy 16. The bottom of the lower buoyancy 14 is joined to a floor 18. A canopy 20 is supported by an inflated arch tube 22. Both are adhered to the upper buoyancy 16.

Adhered to the sides of the lower buoyancy 14 are several anti-capsize water ballast bags FIG. 3. The bags 24 are fabricated of dark-colored rip-stop nylon material. A stainless steel wire 26 is sewn into the lower hem of the bags 24. This wire 26 is to add weight to the bags 24 so they will submerge. The wire 26 also adds a semi-rigid shape to the bags 24. The benefit of the wire 26 is solely to encourage sea water to flow through the bag openings 28 and to be trapped by the flaps 30.

After the life raft FIG. 2 has been launched, it may be boarded from either entrance 32. A webbing ladder 34 is provided for assistance. Once inside the life raft FIG. 2, the user may elect to do nothing. On the other hand, the user may elect to maneuver to a near-by location.

To do this, the user must first lift each bag 24 out of the water so they may be drained. This is done by inserting the user's finger inside the bag opening 28 and holding back the flap 30 until the water drains. Then the bags 24 are fully retracted from the water with the ties 31 secured to the life line 36.

Paddles may be necessary for immediate propulsion. Stowed inside the life raft FIG. 2 is a flat approximately rectangular piece of firm material generally used as a rudder 38. Also inside is a hollow wedge of similar dismensions to the rudder 38, but thicker. This piece is generally used as a lee board 40. The user must remove the contents stowed inside the hollow lee board 40. Now, the rudder 38 and the lee board 40 may be used as jury paddles.

This would be done, for example, on the right or starboard side of the life raft FIG. 2. The user extends the left hand forward, palm open, and facing down. The user takes either jury paddle in the right hand, with the long end of the paddle pointed up, and the flat side facing the user. The user places the top of the jury paddle next to the open left palm. The left hand is closed securing the top of the jury paddle. The user extends the right hand forward with open palm facing left. While keeping the flat side of the paddle facing the user; the user moves the middle of the paddle to the right palm. The palm is closed. The symmetrical action is done with the other jury paddle on the left or port side.

If the user desires to go farther than a near-by location, it will be necessary to convert the life raft FIG. 2 into an effective sailing boat FIG. 1. The gear enclosed must next be examined.

The webbing ladder 34 must be brought on board. The rudder 38 is already available. Next, find the rudder post 42 which is a long thick tube with a length-wise slit FIG. 7*b* on the bottom for the insertion of the rudder 38. Near the top of the post 42 is a large threaded hole for which the threaded tiller 44 will be screwed. Face that hole to the right. The rudder 38 is inserted into the slit 46 so that the small hole in both rudder 38 and rudder post slit 46 are matched, and the larger part of the rudder 38 is on the left side of the slit 46. Now fasten as in FIG. 7*a*.

The assemblage is now inserted into the gudgeons FIG. 5 upward from the bottom until the top of the rudder 38 is at the water line. A small hole 50 is found in the post 42 just above the upper gudgeon 48. A fastener is installed there to prevent the assemblage FIG. 7 from falling into the water. Next, screw the tiller 44 into the hole near the top of the past 42.

Figure 9:
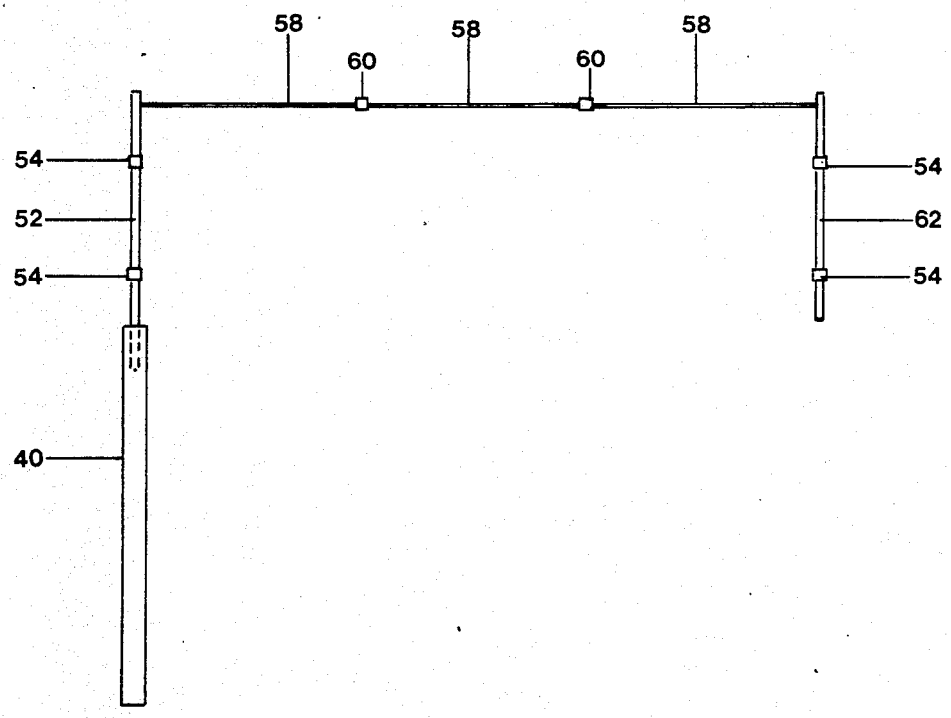
FIG. 9 is a front view of the assembled weather jack, the three section partner with its two couplings, the lee board post, and the lee board.

To facilitate the lee board FIG. 8/weather jack assembly FIG. 9; an independent deflation/inflation valve is provided on the arch tube 22 for lowering the canopy 20.

The lee board post 52 is inserted and fastened into the lee board 40. This union is then inserted upward from the bottom of the preferred lee or down wind lee board mounts 54. (The windward or up wind mounts may also be used but not with the same sailing efficiency.) This installation must be with the elongated edge of the lee board 40 pointing aft and the short edge pointing forward. Small holes in the post 52 are matched to the small holes in the mounts 54 and quick release pins FIG. 6 are inserted in the matched holes.

The three partner pieces 58 and their two couplings 60 are to be assembled FIG. 9 by screwing the partner 58 half way into the coupling 60 until the five pieces are joined. Either end of the assemblage is now screwed into the hole near the top of the lee board post 52. The weather jack 62 has a large threaded hole near its end. That hole is screwed onto the assembled partner. The weather jack 62 is now inserted from the top down into the free lee board mounts 54. Quick release pins 56 are inserted into where lee board mount 54 holes meet weather jack 62 holes.

The mast 64 is next assembled. Three aluminum tubes FIG. 10 with three more aluminum tubes stowed inside are to be disassembled. There are now three wide and three narrow tubes. The tubes are lettered near their ends so that C fits into B, E fits into D, G fits into F, I fits into H, and K fits into J.

Figure 10:
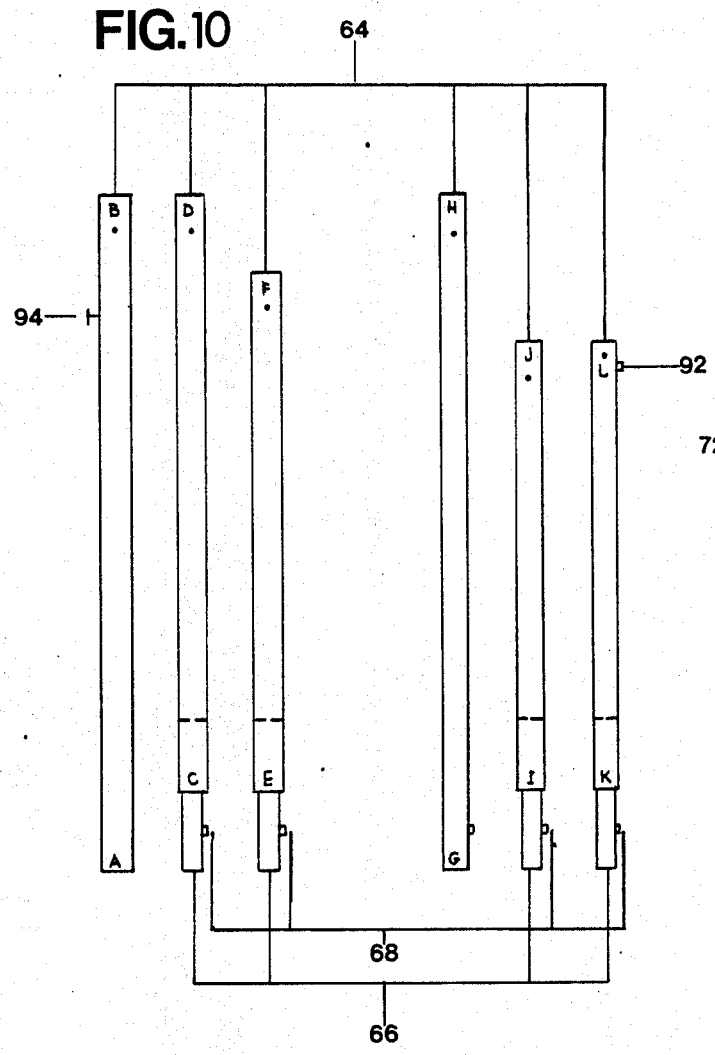
FIG. 10 is a front view of the unassembled mast with its joining inserts and base spring fasteners.

The tubes FIG. 10 are joined by inserts 66 and fastened with base springs 68.

The bottom of the mast 64 is now inserted into the upper end of the main sail 70 sleeve. After this has been done, the top of the main sail 70 is fastened near the top of the mast 64.

Figure 11:
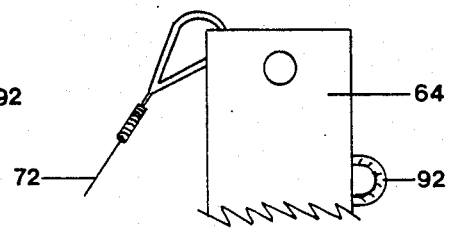
FIG. 11 is a partial view of the top of the mast showing how the rigging is joined there.

The stays 72, which are permanently installed at the top of the mast FIG. 11, are near the halyard 90. They are uncoiled so that they hang near the bottom of the mast 64. The mast 64 is installed forward of the partner 58 into the mast socket 74.

Figure 12:
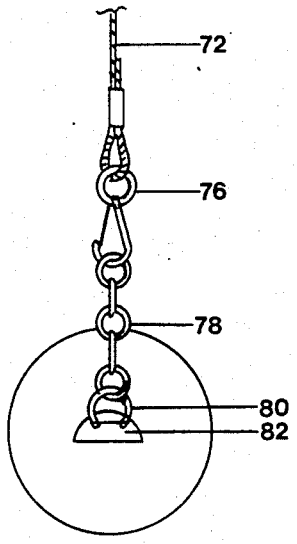
FIG. 12 is a view of the lower rigging, showing how it is joined and adjusted at the hull.

The longest stay 72 is the back stay. At the end of it is a harness snap 76. The snap 76 is hooked to the lower rigging FIG. 12. This lower rigging consists of links of chain 78 to which the snap 76 is hooked. The chain 78 is attached by a shackle 80 to a D-ring patch 82 affixed to the upper buoyancy 16. The other three stays 72 are attached to the other three lower riggings FIG. 12. If there is too much slack in the stays 72, the snap may be hooked to a different link of chain 78.

Figure 4:
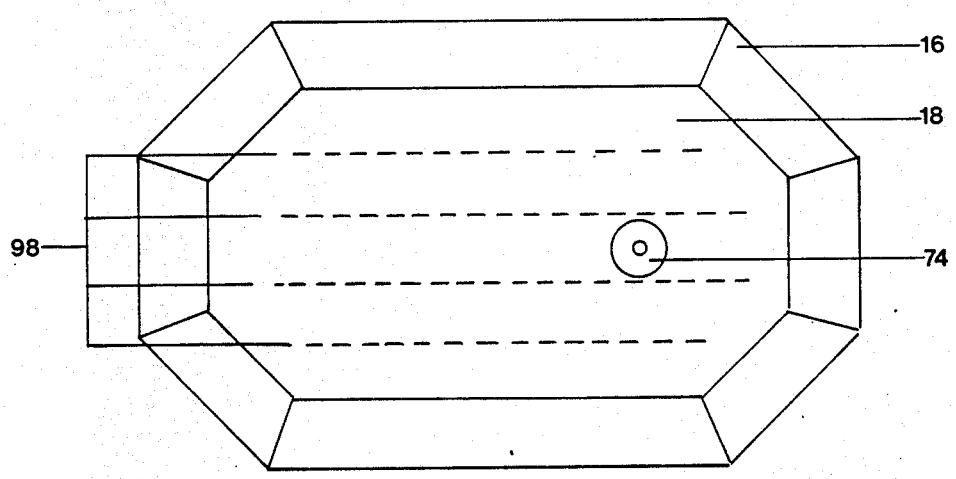
FIG. 4 is a top view of the hull, without canopy, showing the mast socket, mast plate, and air pocket seams.

The jib 84 is attached by the tack pennant 86 to the forward D-ring patch 82. The leading edge of the jib 84 has hanks 88 which hook up to the forward stay 72. The sail is raised by a halyard 90 which runs through a fairlead 92 at the top of the mast FIG. 11. The halyard 90 is belayed at a cleat 94. The floor FIG. 4 with lengthwise seams 98, is manually inflated. Sheets 96 are already attached to the sails 70 and 84.

The conversion from a conventional life raft FIG. 2 to an effective sailing boat FIG. 1 is now complete.

Other embodiments and variations within the scope of the invention will occur to those skilled in the art. It is therefore desired that the invention be measured by the attached claims rather than by the purely illustrative disclosure herein, and all changes and modifications that come within the spirit of the invention are desired to be protected.

I claim:

1. A life raft comprising: an inflatable hull; a mast; means for removably supporting the mast in the hull; at least one sail supported by said mast; a tiller/rudder assembly; and means for removably mounting the tiller/rudder assembly to the hull; a lee board/weather jack assembly; and means for removably mounting the lee board/weather jack to the hull, which includes at least one self-filling water ballast bag retractably secured to the side of the hull so the bag can be retracted for sailing and movement of the boat or lowered for stabilizing the boat.

* * * * *